United States Patent [19]

Wallis

[11] Patent Number: 5,007,270

[45] Date of Patent: Apr. 16, 1991

[54] WEB HANDLING APPARATUS FOR METAL RIBBON STOCK

[76] Inventor: Bernard J. Wallis, 2215 Dacosta, Dearborn, Mich. 48128

[21] Appl. No.: 432,865

[22] Filed: Nov. 7, 1989

[51] Int. Cl.[5] ..... B21D 53/02

[52] U.S. Cl. ..... 72/187; 72/17; 226/44; 242/75.51

[58] Field of Search ..... 72/17, 183, 187; 226/44; 242/75.51, 75.3

[56] References Cited

U.S. PATENT DOCUMENTS

| | | | |
|---|---|---|---|
| 2,729,267 | 1/1956 | Walton | 72/183 |
| 3,154,011 | 10/1964 | Gottscho et al. | 226/44 |
| 3,501,075 | 3/1970 | Scharf | 226/44 |
| 3,645,430 | 2/1972 | Lagain | 226/44 |
| 4,076,184 | 2/1978 | Morgan | 242/75.3 |
| 4,507,948 | 4/1985 | Wallis | 72/187 |
| 4,741,192 | 5/1988 | Wallis | 72/187 |

*Primary Examiner*—Robert L. Spruill
*Attorney, Agent, or Firm*—Barnes, Kisselle, Raisch, Choate, Whittemore & Hulbert

[57] ABSTRACT

A web handling apparatus for supplying material to a metal forming machine wherein an uncoiler unit is mounted on a frame to draw metal web from a coil. A pivot support is mounted on the frame and supports a dancer arm with a track roller assembly. The dancer arm is pivoted to the roller assembly at one end and is connected to a pivot support at the other end in a manner such that the arm is capable of relative movement axially with respect to the pivot. Movement of the track roller assembly is limited to a vertical path by a pair of vertical tracks on the frame. The pivot support is connected to a rotary transducer for controlling the speed of drive rolls which regulate the delivery of metal web into the metal forming machine.

4 Claims, 5 Drawing Sheets

WEB HANDLING APPARATUS FOR METAL RIBBON STOCK

This invention relates to web handling of metal ribbon web and more particularly, to the handling of metal ribbon stock from a coil into a corrugated fin rolling machine.

BACKGROUND AND SUMMARY OF THE INVENTION

For accurate manufacture of corrugated products, a machine must have a systematic and meticulous material handling apparatus. This handling apparatus must supply a reliable and consistent flow of material to the corrugating machine.

The manufacture of corrugated metal strips entails a feeding of metal ribbon web from a coil to a series of forming rolls. Typical apparatus for use in Such manufacture is shown, for example, in U.S. Pat. Nos. 3,998,600, 4,067,219, 4,262,568, and 4,507,948. Typically the ribbon web is dispensed from a coil by pinch rollers or the like. Coil inertia and drag during start-up adversely affect control of the fin height of the finished product. Moreover, such inertia and drag vary as coil diameter decreases. In the event of a machine shutdown, coil momentum continues to unwind ribbon web.

Generally, a dancer arm is pivoted to the handling apparatus and has a weighted roller on its free end to contact the metal ribbon web to take up the slack from coil momentum. The dancer arm provides a signal to a controller for varying the speed of the coil drive motor which controls the feed rolls and acts as an accumulator of the metal ribbon web before introduction into the form rolls of the machine.

Typically, a dancer arm has a fixed pivot and travels in a uniform arc. A dancer arm at the mid-point of its arc or normal position signifies that the metal stock is travelling a speed equal to the normal operating speed of the fin rolling machine. When the dancer arm is at the bottom of its arc or the low position, the coil drive motor speed is too fast causing slack in the metal ribbon web. If the dancer arm is in its high position, the coil drive motor is too slow and therefore not providing enough metal ribbon web to the machine and causing excessive tension on the metal web.

When the dancer arm is not in the normal position, a signal is sent to the controller to accelerate or decelerate the coil drive speed. As the arc of movement of the dancer arm moves away from a neutral position, the magnitude of the signal increases for each increment of movement of the dancer arm. Thus, if the coil drive motor is accelerated, the metal ribbon web may be fed too fast, thereby causing slack in the metal ribbon web. If the dancer arm, with its weight on the end, swings to the low position with a force equal to the weight times the distance from the pivot point, excess force may be provided on the metal web and may result in breakage of the metal ribbon web.

Also in such prior arrangements, three motors are required and necessitate a sophisticated control system to synchronize the speeds of a coil drive motor, a machine drive motor and a web handling drive motor.

Among the objectives of the present invention are to provide a web handling apparatus which will supply a metal ribbon web to a metal rolling machine at a speed that produces quality parts efficiently; which has a dancer arm that will not create excessive slack or a force so great as to break the metal web; which has a dancer arm in association with a number of guide rollers to act as an accumulator; which includes a control system so that the speed of the handling drive motor is varied as the dancer arm deviates from the mid-point or normal operating position to provide uniform control of the drive motor throughout the movement of the dancer arm; and which is cost effective, utilizing fewer controls and one less motor.

In accordance with the invention, an accumulator apparatus comprises a dancer arm, a track roller assembly carried on one end of the arm and at least one vertical track for directing the track roller assembly in a substantially straight line vertical path. The accumulator apparatus also has a pivot on which the other end of the arm is attached, the other end of the arm is constructed so that there is relative movement of the arm axially with respect to the pivot.

DESCRIPTION

Figure 1:
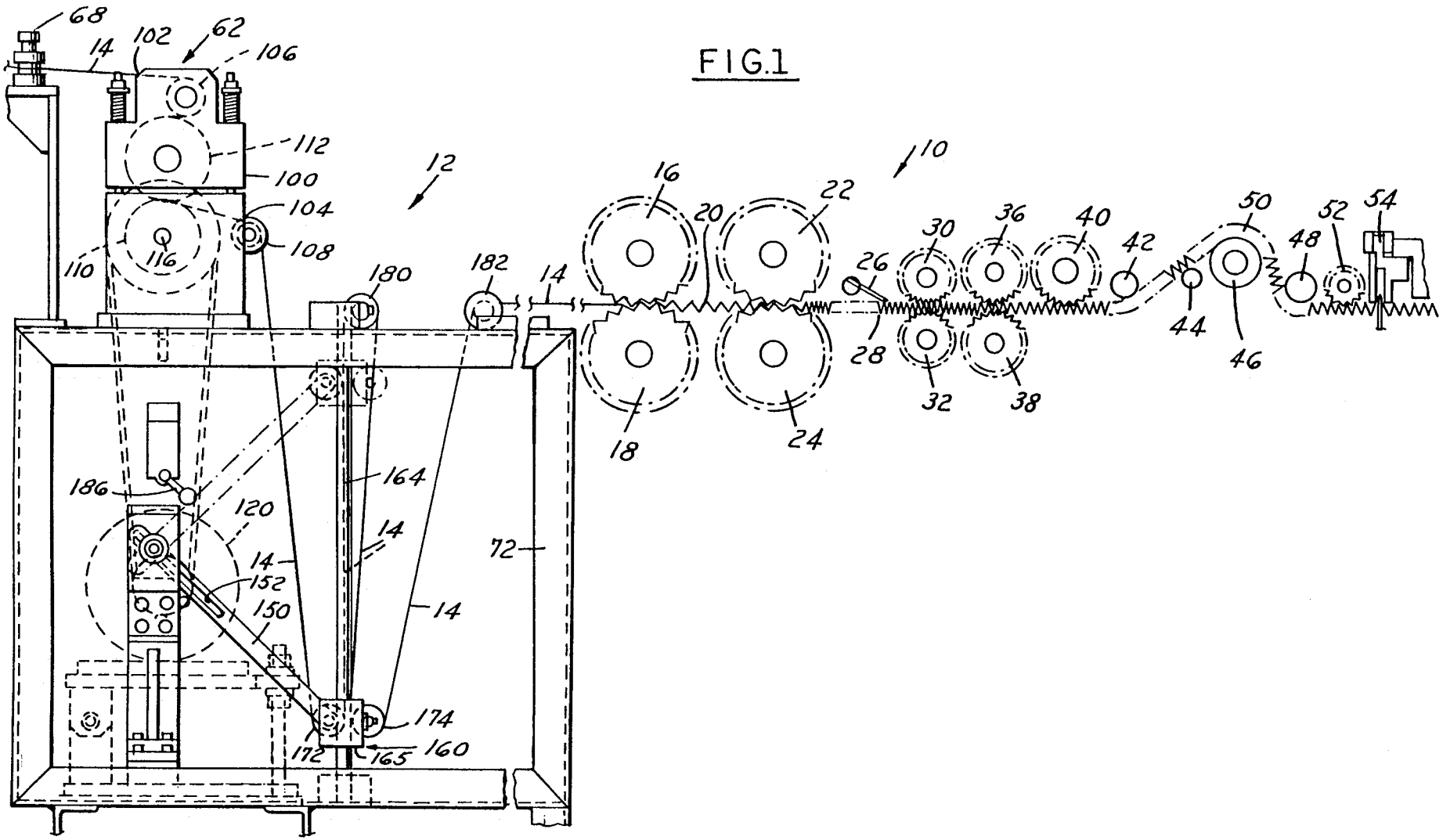
FIG. 1 is a partly diagrammatic elevational view of an apparatus for forming corrugated strip including a web handling apparatus in accordance with the present invention.

Referring to FIG. 1, a corrugated fin rolling machine 10 embodying the invention comprises a web handling apparatus 12 which feeds sheet metal web 14 from a coil 60 into a pair of intermeshing forming rolls 16, 18 mounted on the frame of the rolling machine 10. Rolls 16, 18 form a corrugated metal web 20 which is fed successively through gathering rolls 22, 24 which compress the corrugations of the strip 20 together and through a spring pressure plate 26 which insures that the strip 20 remains in contact with bottom supporting rail 28 so that the strip 20 advances to the next station.

The strip 20 is advanced into two pairs of toothed feed rolls 30, 32 and 36, 38 which properly space the corrugations of the strip 20. Each pair is spaced vertically from each other so that the teeth on the upper rolls 30, 36 engage between the successive upper crest of the corrugated strip 20 and teeth of the lower rolls 32, 38 engage between the successive lower crest on the corrugated strip 20.

An additional roll 40 is located downstream in the path of travel and is supported above the strip 20 so that the teeth thereof engage between the top crest of the strip advancing on rail 28. The corrugated strip 20 is advanced through idler rolls 42, 44, 46, 48 to form a take-up loop 50. From the take-up loop the corrugated strip 20 is advanced into a toothed roll 52 which feeds the corrugated strip 20 into cutting station 54 to be cut into required lengths.

It should be noted that all rolls prior to loop 50 are constantly rotating and feeding corrugated strip 20 towards the cutter 54, roll 52 after the loop 50 intermittently rotates and thus advances the desired length of corrugated strip 20 to the cutter 54. This intermittent operation results in a backup of corrugated strip, which is accommodated by take-up loop 50.

Figure 2:
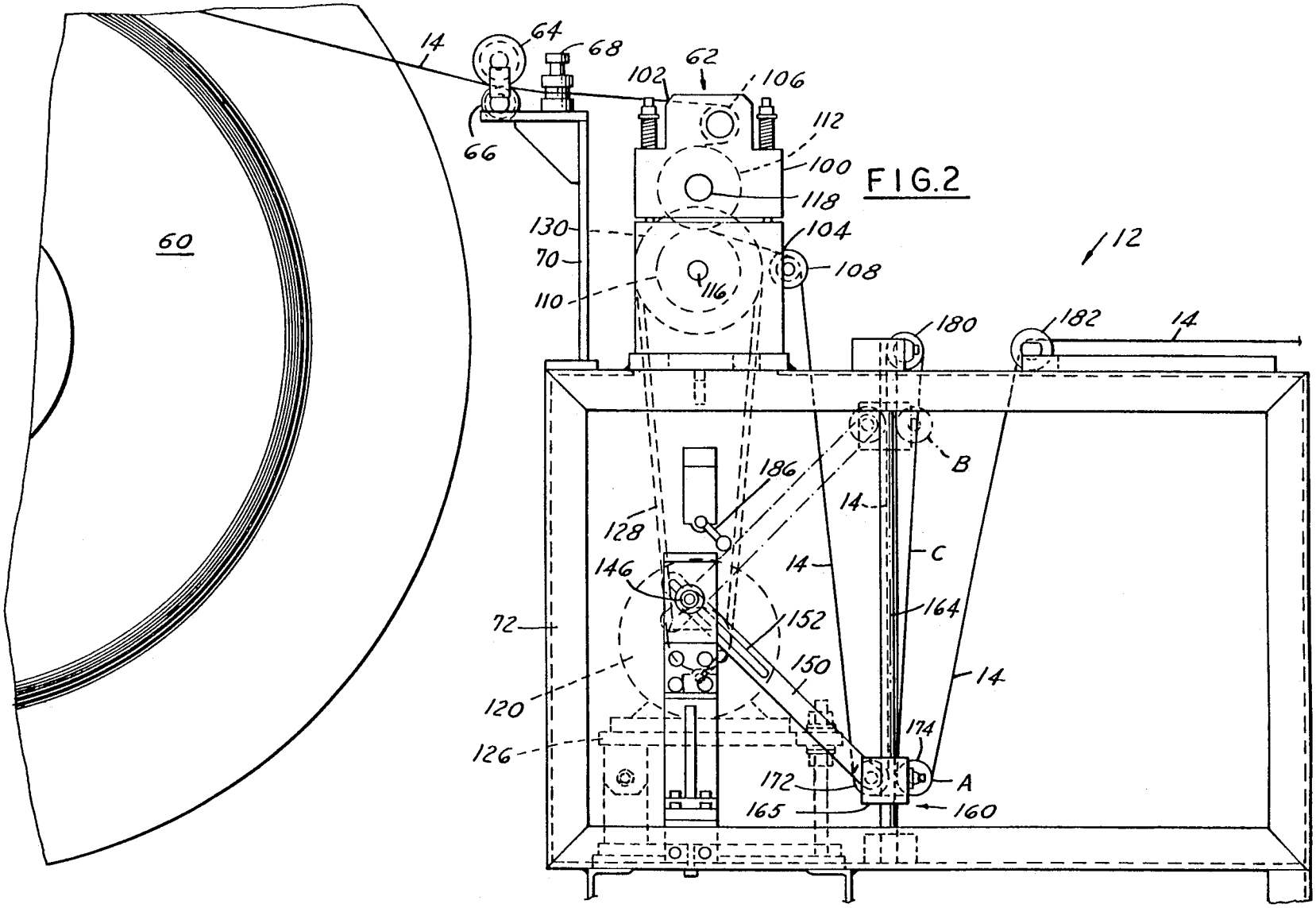
FIG. 2 is an enlarged fragmentary elevational view of the web handling apparatus.

As shown in FIG. 2, the web handling apparatus 12 removes the metal web 14 from coil 60 and handles the metal web 14 so that it is supplied in an orderly and uniform flow to the corrugating fin rolling machine 10. The web 14 is taken from coil 60 by an uncoiler unit 62. The ribbon web 14 is advanced through a pair of guide rollers 64, 66 and into a thickness gauge block 68, both of which properly align the metal web 14 with the entrance of the uncoiler unit 62. Both guide rollers 64, 66 and gauge block 68 are mounted on a support 70 which is fixedly attached to the front end of frame 72.

Figure 4:
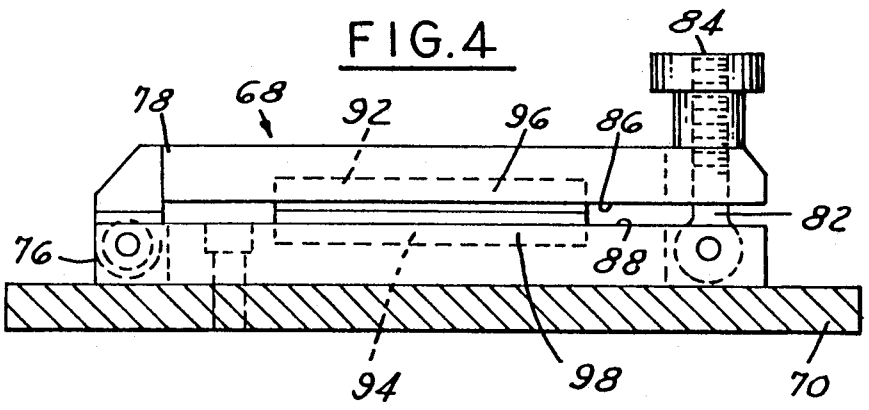
FIG. 4 is a fragmentary enlarged sectional view taken along line 4—4 in FIG. 3.
Figure 3:
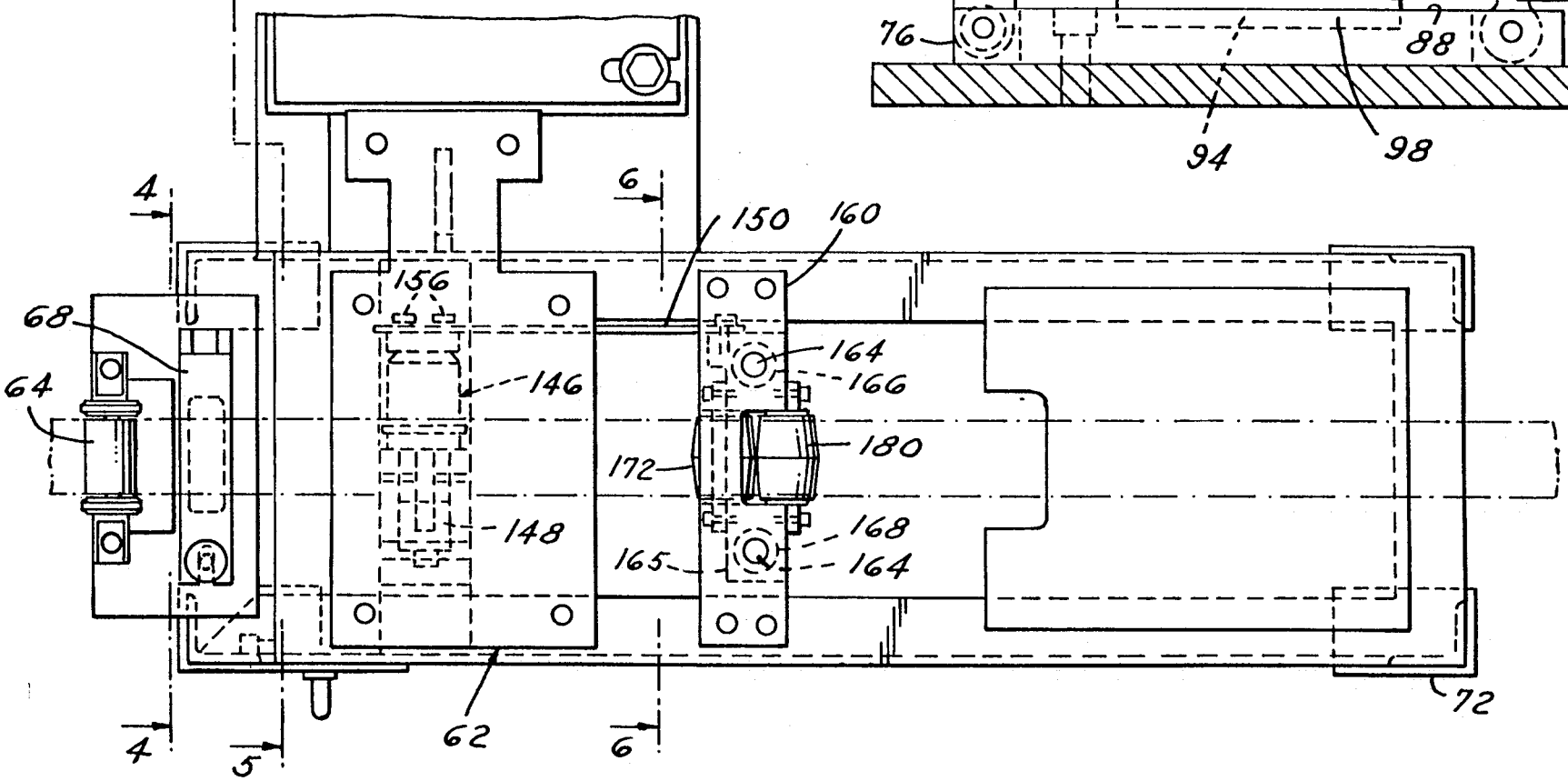
FIG. 3 is a fragmentary plan view of a portion of the web handling apparatus shown in FIG. 2.

As shown in FIG. 4, gauge block 68 has a base 76 which is preferably bolted to the top portion of support 70. An upper plate 78 is pivoted at one end to base 76. The opposite end of plate 78 is clamped on plate 76 by an eyelet bolt 82 pivoted to base 76 and extending through an opening in plate 78. A nut 84 is threaded on the threaded end of eye bolt 82 and when tightened causes inner face 86 of upper plate 78 to be parallel to the open face 88 of base plate 76. Each face 86, 88 has a channel 92, 94 which is in a mirror image relationship with each other. Each channel 92, 94 holds matching replaceable gauge blocks 96, 98, so that only metal ribbon web of the correct gauge may be advanced to the metal forming machine.

Uncoiler unit 62 includes a housing 100 having an inlet 102 and an outlet 104, each of which has a guide roller 106, 108 journaled for rotation and mounted in the housing 100. The roller 106 guides metal web 14 to a pair of pinch rollers 110, 112 which draw the metal web 14 from the coil 60 and advance the metal web 14 over exit guide roller 108.

Pinch roller 110 is the drive roller for the handling apparatus 12 and is keyed to a drive shaft 116 which is journaled for rotation in housing 100. Pinch roller 112 is the idler roller keyed to shaft 118 which is journaled for rotation in housing 100 and engages drive roller 110.

Figure 5:
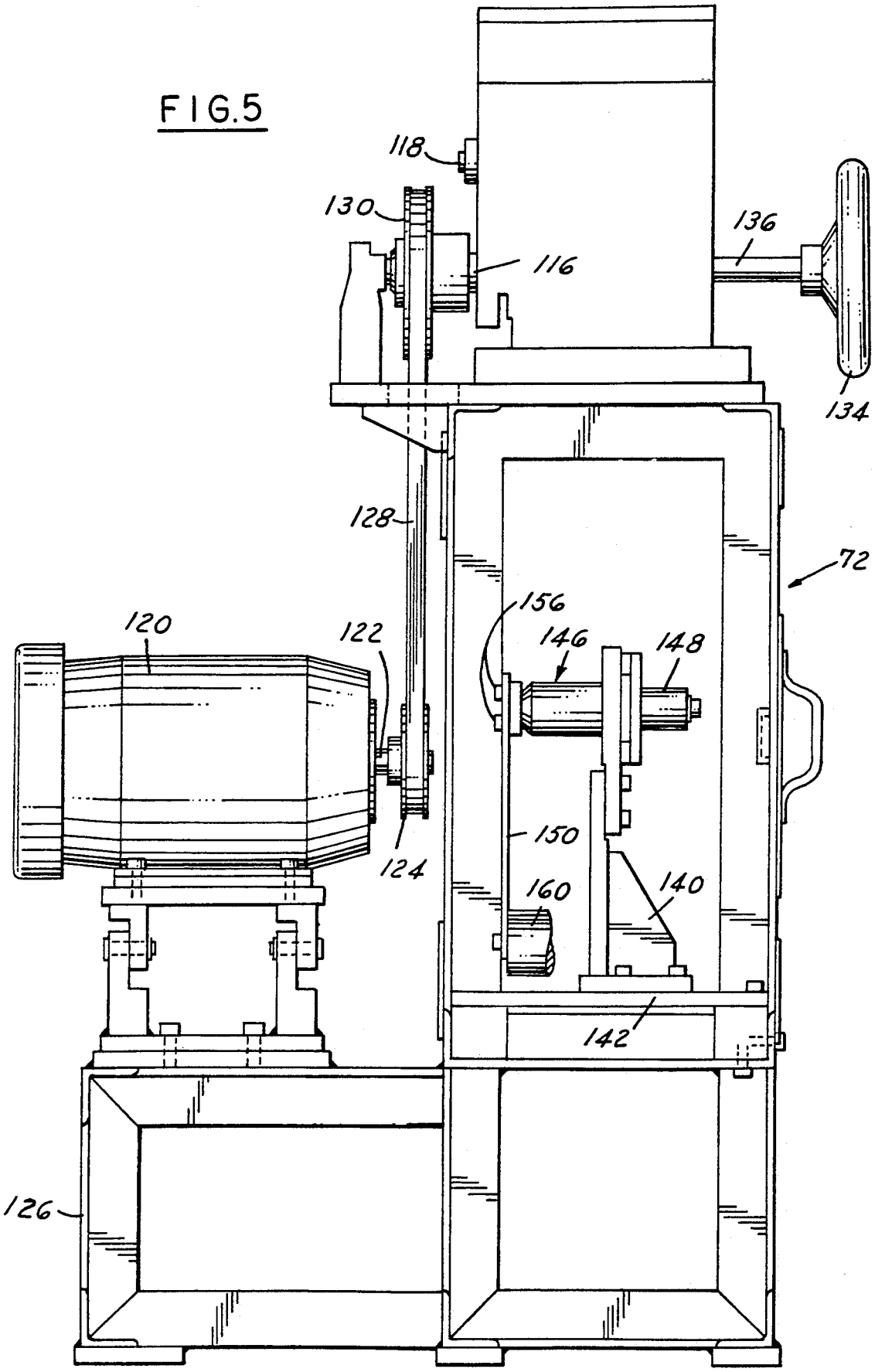
FIG. 5 is an enlarged sectional view taken along line 5—5 in FIG. 3.

Referring to FIG. 5, a drive motor 120 is mounted on frame 126 alongside frame 72 and has an output shaft 122 on which a pulley 124 is keyed. A belt 128 is trained over pulley 124 and a pulley 130 keyed to drive shaft 116 for the pinch rollers 110, 112. For manual control of the pinch rollers 110, 112, a drive wheel 134 is keyed on an extension 136 connected to the other end of drive shaft 116. This wheel 134 permits an operator to manually feed metal web 14 into the web handling apparatus 12.

Within frame 72, a pivot support 140 is bolted on base 142 as shown in FIG. 5. The pivot support 140 has a pivot 146 which supports a RVDT transducer 148 and a dancer arm 150. The arm 150 has a slot 152 which is received on pivot 146 and fixed on pivot 146 by a pair of bolts 156. These bolts 156 insure that the arm will not freely move about pivot 146 without translating the radial position of arm 150 with respect to RVDT transducer 148.

Figure 6:
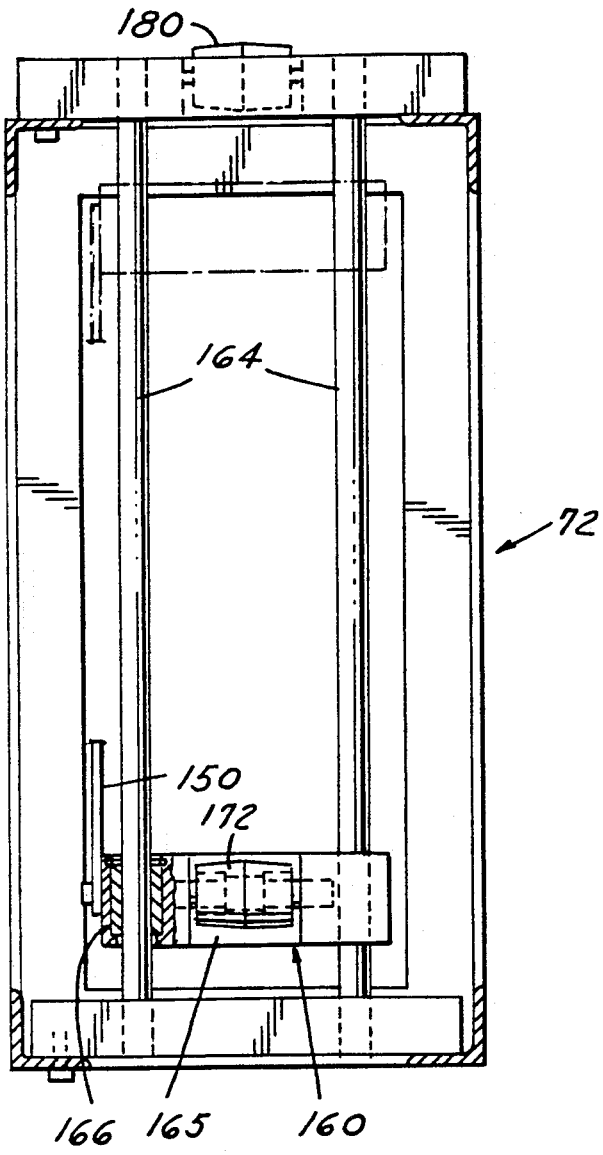
FIG. 6 is an enlarged sectional view taken along line 6—6 in FIG. 3.
Figure 7:
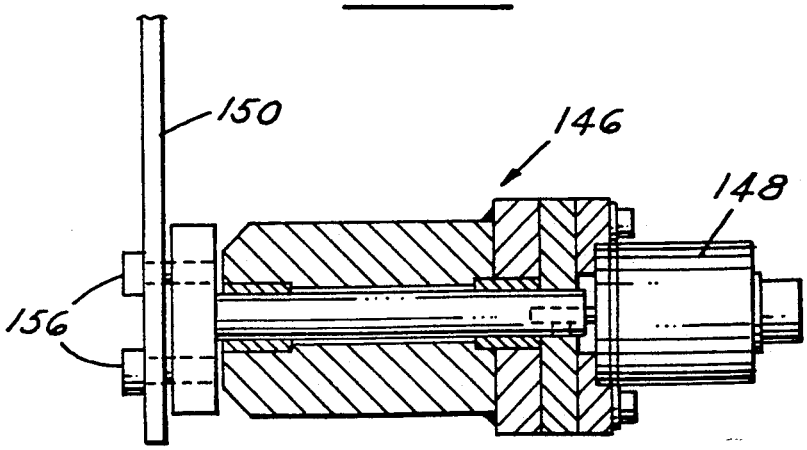
FIG. 7 is an enlarged fragmentary part sectional view showing a RVDT transducer and pivot of the present invention.

Arm 150 has a track roller assembly 160 attached to the free end thereof. A pair of shafts 164 define a vertical track and are fixed and centrally located on the frame 72. The track roller assembly 160 includes a slide 165 supporting bearing elements 166, 168 and rotatably supporting a pair of guide rollers 172, 174 in a laterally spaced relationship between bearings 166, 168 (FIG. 6). Preferably, guide rollers 172, 174 are at least as wide as the metal ribbon web 14. Vertical shafts 164 extend through bearings 166, 168 of slide 165 resulting in the surface of shafts 164 juxtaposed to bearings 166, 168. A guide roller 180 is attached to the top of frame 72 and is located directly above the roller track assembly 160 and vertically aligned with guide rollers 172, 174. Another guide roller 182 attached to the top of frame 72 downstream from and at the same elevation as guide roller 180. The web is trained under roller 172, over roller 180 downwardly under roller 174 and up over roller 182 to the corrugating machine. Both guide rollers 180, 182 function in conjunction with movable guide rollers 172, 174 as accumulators of the metal ribbon web 14. The axis of each roller for accumulation is parallel to the other accumulation rollers.

It can be seen that the track roller assembly 160 on the dancer arm 150 is mounted for movement in a straight vertical line and the other end of the dancer arm 150 is mounted for rotary movement about a fixed pivot axis while it may have limited axial movement along its length relative to the fixed pivot axis. As a result, each increment of rotary movement of dancer arm 150 will produce the same signal regardless of the position of the track roller assembly 160. This may be contrasted to the prior art dancer arms wherein the roller assembly on the arm is moved in an arcuate path so that as the roller assembly moves further from a central or normal position the increment of rotary movement of the fixed length dancer arm increases and does not remain the same. As a result, in the prior art, a greater correction is made in the speed of drive motor than is required.

In operation, the web handling apparatus 12 provides consistent and adequate supply of metal web 14 to form rolls 16 of the fin rolling machine 10. The metal web 14 is fed clockwise from coil 60 into and aligned through guide rollers 64, 66. The metal web 14 is then advanced through the thickness guide block 68 and into the inlet 102 of uncoiler unit 62. Metal web 14 is wrapped around guide roller 106 and introduced between pinch rollers 110 and 112. The metal ribbon web 14 is then drawn through outlet 104 over guide roller 108.

After leaving the uncoiler unit 62, the metal web 14 passes down and through frame 72 to wrap around guide roller 172 of the track roller assembly 160, up to and over accumulator guide roller 180, down and around to guide roller 174 of the roller track assembly 160 and then up and over guide roller 182 and is then introduced into the corrugating fin rolling machine 10.

As the machine 10 produces parts, the dancer arm 150 may move between two extreme positions, a low position and a high position, and generally is found in the vicinity of the mid-point or normal position. In this normal or mid-point position the web handling apparatus is feeding a sufficient supply of metal web to the fin rolling machine 10.

When dancer arm 150 and track roller assembly 160 are in the low position A, drive motor 120 is at a speed which may be supplying a web at a faster speed than the speed at which the fin rolling machine 10 is making corrugated fins, or the web handling apparatus 12 may be out of material to feed to machine 10. In such a situation, the RVDT transducer 148 sends a signal to reduce the speed of motor 120 until the arm 150 is elevated to the mid-point or normal position If the arm fails to rise to the mid-point, due to the absence of a web, the transducer keeps sending a signal to slow down the motor until the motor eventually stops or shuts off.

If the dancer arm 150 is at a high position B, then motor 120 may not be feeding the metal web at a speed fast enough or the coil on the reel stand may be causing too much of a drag on the web handling apparatus 12. An on-off limit arm switch 186 engages the dancer arm 150 as it approaches the high position B, and turns off the motor 120 and the fin rolling machine. When dancer arm 150 is in position B, a greater angle is realized by the transducer 148 which translates into a greater signal to the motor 120 to increase the speed of metal web feed so that the arm 150 and track roller assembly 160 is lowered to the normal or mid-point position.

Where a dancer arm has a fixed pivot and the transducer sends the signal to the motor to speed up the supply of metal web, the motor may accelerate too fast and provide too much metal web for the machine 10 to process and result in the breakage of the web by the weighted roller assembly. Due to the arrangement of slotted arm 150, track roller assembly 160 and vertical tracks 164, the metal ribbon web will not be severed by the dancer arm assembly As the roller track assembly 160 moves vertically down tracks 164, the slot 152 slides across bolts 156 and reduces the length of the moment arm and effectively reduce the force on the metal ribbon web 14. Thus, when the roller track assembly 160 moves from high position B, the force of the roller track assembly 160 and arm 150 on the metal ribbon web will be much less than the force of a fixed pivoted dancer arm. This prevents breakage of the metal ribbon web and reduces down time of the fin rolling machine 10.

The combination of the roller track assembly 160 with the slotted arm 150 and transducer 148 eliminates the need for synchronizing the motor speed of handling drive motor 120 with the line production feed of machine 10. In addition, the properly sized drive motor 120 eliminates the need for a reel drive motor.

The present invention thus provides a web handling apparatus which supplies metal ribbon web to a metal rolling machine at a speed that produces quality parts efficiently; which has a dancer arm that will not create excessive slack or a force so great as to break the metal web; which has a dancer arm in association with the number of guide rollers to act as an accumulator; which includes a control system so that the speed of the handling drive motor is varied as the dancer arm deviates from the midpoint or normal operating position; and which is cost effective, utilizing fewer controls and one less motor.

I claim:

1. In a metal fin forming machine wherein a metal web is fed from a coil to a plurality of continuously rotating rolls for corrugating the web, the improvement comprises a web handling apparatus comprising:

a frame, uncoiling means adjacent said coil and fixedly attached to said frame for uncoiling the metal web from the coil, said uncoiling means having a housing with a pair of drive pinch rollers centrally located and attached to said housing, an entry guide roller attached to an entrance of said housing for guiding the metal web into said drive pinch rollers and an exit guide roller attached to an exit of said housing for guiding the web from the housing, a drive motor mounted alongside said frame for driving said pinch rollers, an accumulator apparatus disposed between said uncoiling means and the metal fin forming machine comprising a pair of vertical tracks on said frame and a movable track roller assembly movably mounted on said vertical tracks for taking up slack in the metal web, a dancer arm in advance of said metal fin forming machine, pivoted at one end to one of said accumulator rollers over which the web is fed by said uncoiling means, pivot means for pivoting the other end of said dancer arm about a fixed axis while permitting axial movement thereof relative to said pivot means, a RVDT transducer attached to the pivot means and electrically connected to said drive motor to provide a signal due to rotary movement of said arm for controlling the speed of said drive motor, and said movable track roller assembly comprising first and second movable guide rollers supported on said movable track roller assembly and guided on said tracks for vertical movement thereon and first and second stationary guide rollers supported on said frame and located above said movable track roller assembly, said web being trained in succession from said uncoiling means under said first movable guide roller, thereafter over said first stationary guide roller, under said second movable guide roller, over said second stationary guide roller and into said metal fin forming machine.

2. The web handling apparatus of claim 1 wherein said drive motor has an output shaft engaging a belt for driving said drive pinch rollers.

3. The web handling apparatus of claim 2 further comprising means for interrupting the operation of said drive motor in the absence of a web.

4. The web handling apparatus of claim 1 wherein said pivot means comprises a pivot support mounted on a base of said frame adjacent said drive motor, said pivot support having a pivot which supports said RVDT transducer, said dancer arm having a slot at said other end which is received on said pivot and fixed thereto so that said dancer arm is allowed to pivoted therewith and move axially and translate radial positions of said dancer arm to said RVDT transducer for controlling said drive motor.

* * * * *